United States Patent [19]

Dudek et al.

[11] Patent Number: 4,611,719

[45] Date of Patent: Sep. 16, 1986

[54] HOLDER FOR WORKING WITH COMPUTER PRINT-OUTS

[76] Inventors: D'Ann Dudek; Wilma Dudek, both of 12160 Catawba Ct., Lockport, Ill. 60441

[21] Appl. No.: 641,232

[22] Filed: Aug. 16, 1984

[51] Int. Cl.[4] ..... A47F 7/00

[52] U.S. Cl. ..... 211/50; 211/57.1; 248/465

[58] Field of Search ..... 211/50, 57.1; 248/454, 248/465

[56] References Cited

U.S. PATENT DOCUMENTS

| | | | |
|---|---|---|---|
| 469,436 | 2/1892 | Lindemeyer | 248/465 |
| 575,270 | 1/1897 | Plant | 248/465 X |
| 972,709 | 10/1910 | Nelson | 211/50 X |
| 1,023,329 | 4/1912 | Payne | 211/50 X |
| 1,175,649 | 3/1916 | McBee | 211/50 |
| 2,149,978 | 3/1939 | Noel | 211/50 X |
| 2,965,159 | 12/1960 | Fridolph | 248/465 |
| 3,473,671 | 10/1969 | Gangitano | 211/57.1 X |
| 3,918,589 | 11/1975 | Nausedas | 211/57.1 |

FOREIGN PATENT DOCUMENTS

| | | | |
|---|---|---|---|
| 562593 | 6/1975 | Switzerland | 211/59.1 |

*Primary Examiner*—Robert W. Gibson, Jr.
*Attorney, Agent, or Firm*—Ernest Kettelson

[57] ABSTRACT

A holder for working with computer print-outs comprising first and second support panels to support a computer print-out on one of such panels which displays one printed side of such print-out and to support turned over sheets thereof on the other of said panels which displays the reverse printed side of such print-out, including means to hold the computer print-out or portions thereof on each of said panels.

4 Claims, 14 Drawing Figures

HOLDER FOR WORKING WITH COMPUTER PRINT-OUTS

BACKGROUND OF THE INVENTION

This invention relates to the field of devices for holding computer print-outs in working position for persons who have to work with and process the information contained on such computer print-outs.

Computer print-outs have become well known to the business world and office worker who have to work with them to utilize the information contained therein. They are typically bulky continuous form sheets of paper folded one on another with perforations for each sheet along the fold lines, and with margins along each opposite side usually perforated so they can be separated from the print-out if and when desired, the margins having uniformly spaced apart apertures therein for engagement by the corresponding teeth of the drive mechanism of printers which move the sheets of the computer print-outs through the printers as the information is being rapidly printed thereon.

The typical computer print-out may have sheets about fifteen inches wide by about eleven inches in length or in the longitudinal dimension, and may comprise a number of sheets when folded one on top of another that is four inches or more across the span from the top most sheet to the bottom.

Such print-outs are obviously awkward and difficult to work with. Some prior art methods of trying to deal with this problem include separating all of the perforated sheets and then binding them between hard covers to form a kind of book. Inasmuch as these computer print-outs are typically for only temporary use after which they can be discarded since the permanent information is stored in the computer, it is wasteful and unnecessary to bind the print-outs between costly hard covers just to be able to turn the pages and otherwise handle them while processing the information contained thereon.

The present invention solves that problem by providing a holder which can readily accept the computer print-outs thereon and hold them in place for turning of pages and otherwise handling, after which the computer print-outs can be discarded or stored if desired without incurring the time and expense of binding between hard covers. The holders in accordance with the present invention can be used repeatedly with successive print-outs without the need for purchasing numerous hard covers or other binding and backing sheets for print-outs whose usefulness has ended after having been initially processed.

To illustrate the state of the known prior art relative to this invention, U.S. Pat. No. 4,313,112 discloses a work table for use with a computer and its display screen but not for working with computer print-outs per se. The U.S. Pat. No. 4,213,520 discloses an artist's portfolio which vaguely resembles one modification of the present invention as far as its exterior configuration is concerned but is in a different field of art and would be unworkable with computer print-outs. Another U.S. Pat. No. 4,105,182 discloses a stand or study device having a similar exterior configuration but it is also in a different field of art and intended for such things as supporting a speaker's notes on a lectern. It has no means for holding a computer print-out in manageable form thereon, or for flipping sheets of a computer print-out over to a second panel to be similarly held and managed on the second panel.

The U.S. Pat. Nos. 4,044,980 and 3,380,701 show holders that have an exterior configuration similar to another modifictaion of the present invention, but they too are in different fields of art. They do not include any means for holding and managing bulky continuous form computer print-outs thereon, and would be unuseable for that purpose.

Other prior art patents include U.S. Pat. Nos. 3,348,325 and 807,783 which disclose the use of pegs through holes in paper sheets to hold them on a display board, but again they are in completely different fields of art such as tabbed index cards in the one case and a tabbed file of separated billing sheets in the other held together by binding arches.

SUMMARY OF THE INVENTION

It is an object of the invention to provide a holder for working with a computer print-out comprising two support panels, one to support the computer print-out in a position to display one side of a fold over sheet thereof and the other to support the print-out in a position to display the reverse side of said fold over sheet.

It is an object of the invention to provide a holder for working with a computer print-out wherein the entire print-out is held securely in place as each page thereof is worked on and processed.

DESCRIPTION OF PREFERRED EMBODIMENT

Figure 1:
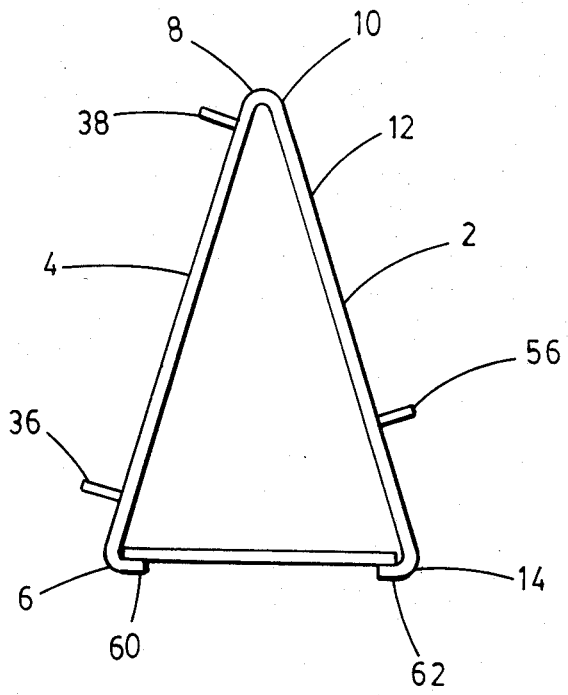
FIG. 1 is a side elevation of one modification of a holder in accordance with this invention for working with a computer print-out.
Figure 2:
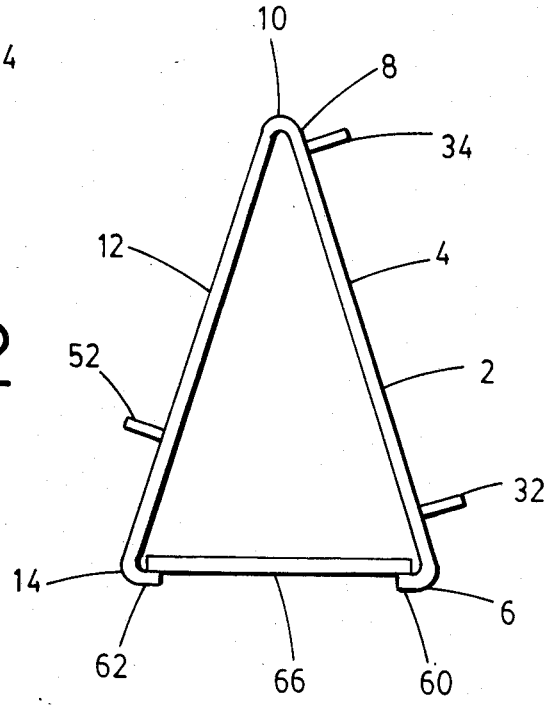
FIG. 2 is a side elevation showing the opposite side of the holder shown in FIG. 1.
Figure 3:
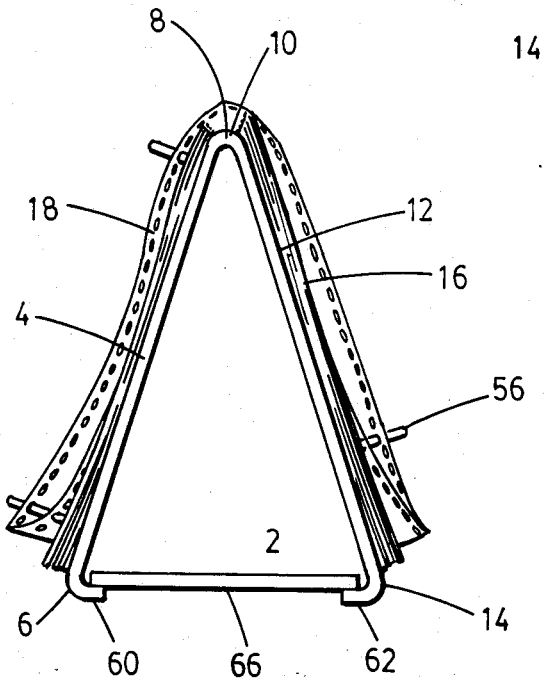
FIG. 3 is a side elevation view of a holder as shown in FIG. 1 having a computer print-out in position thereon.
Figure 4:
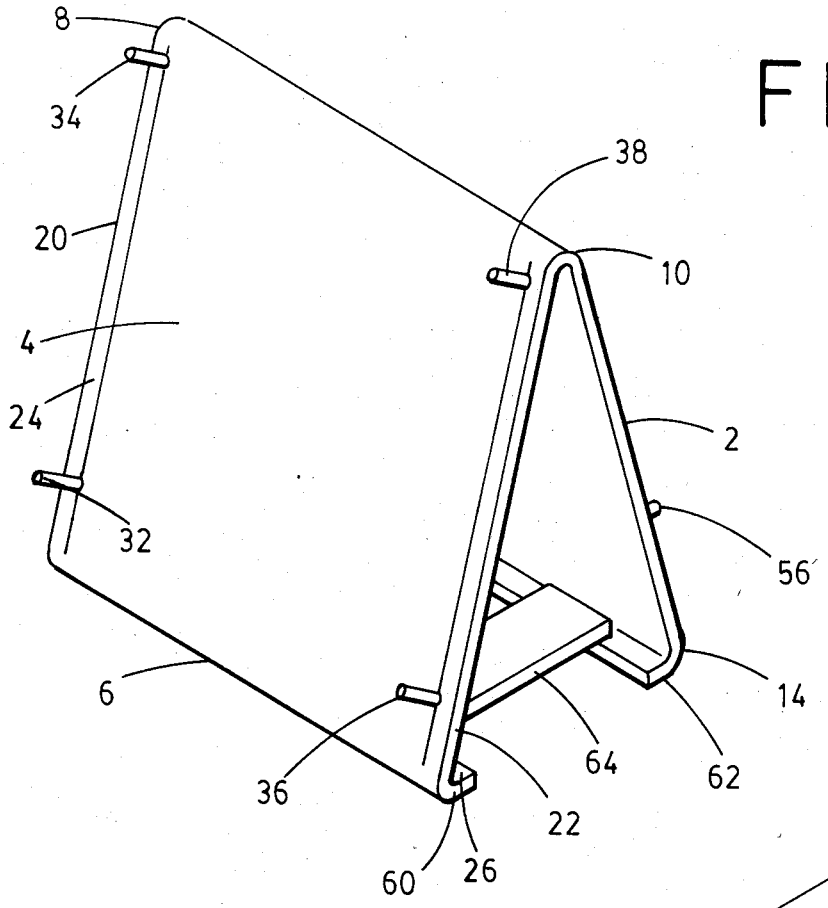
FIG. 4 is a perspective view of a holder as shown in FIG. 1.
Figure 5:
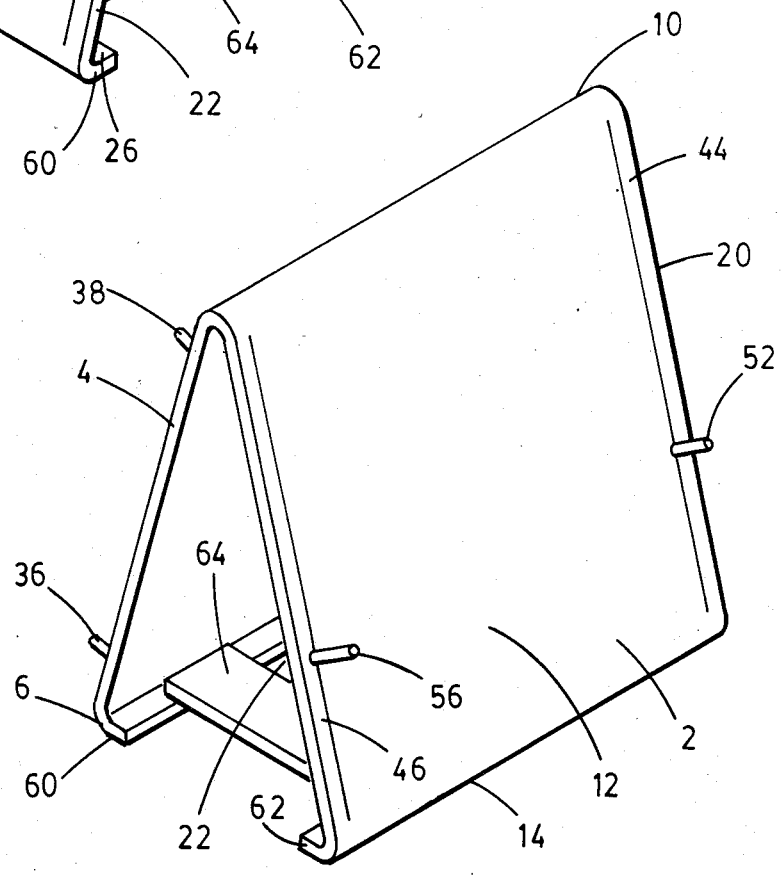
FIG. 5 is a perspective view as in FIG. 4 but taken from the opposite side.
Figure 6:
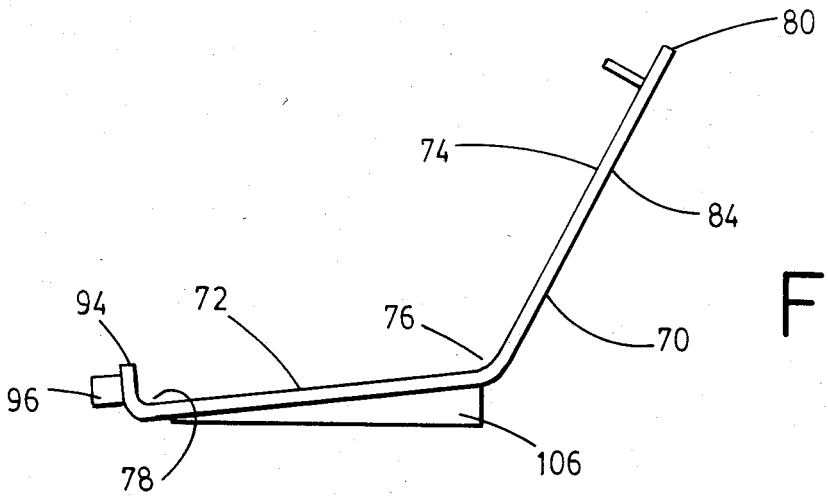
FIG. 6 is a side elevation of another modification of a holder in accordance with this invention for working with computer print-out.
Figure 7:
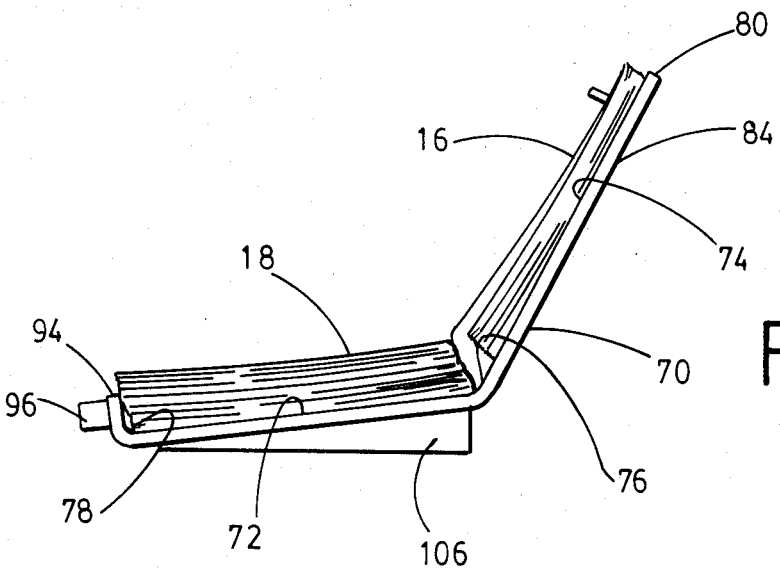
FIG. 7 is a side elevation view of the holder in FIG. 6 having a computer print-out in position thereon.
Figure 8:
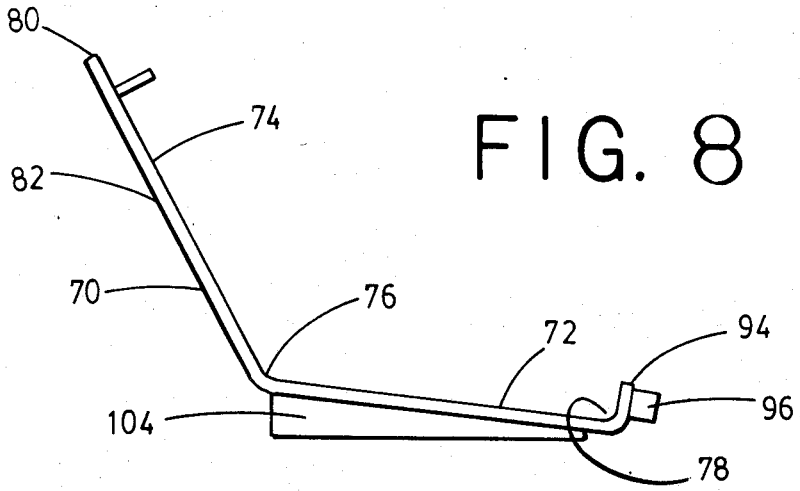
FIG. 8 is a side elevation of the holder of FIG. 6 showing the opposite side thereof.
Figure 9:
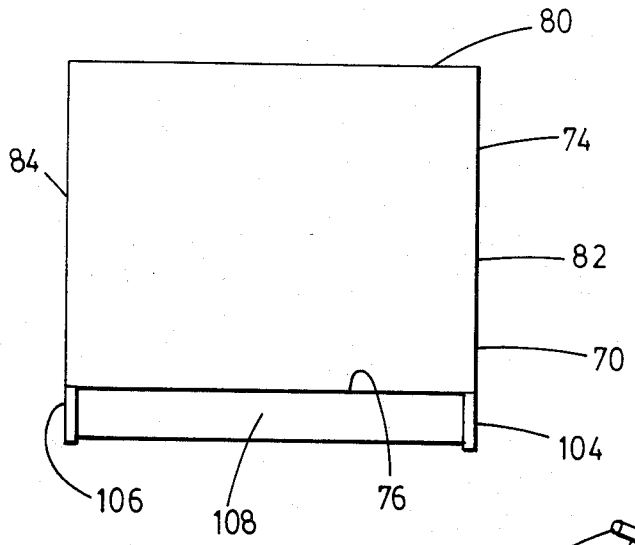
FIG. 9 is an elevation view of the holder of FIG. 6 taken from the front end.
Figure 10:
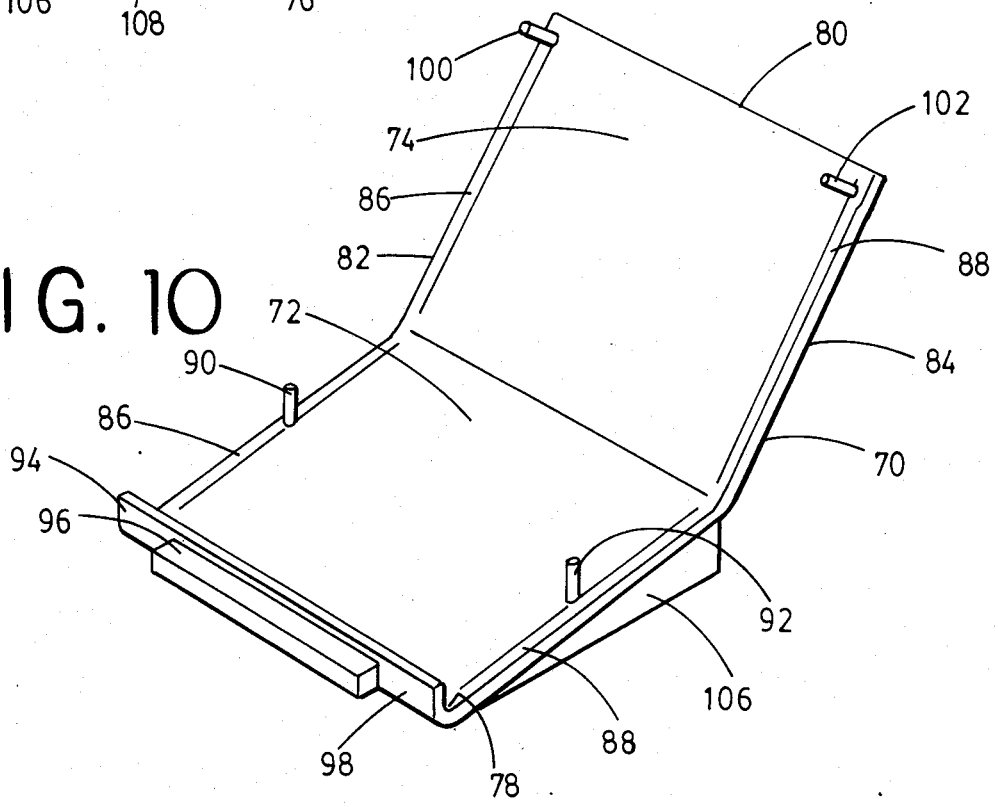
FIG. 10 is a perspective view of the holder shown in FIG. 6.
Figure 13:
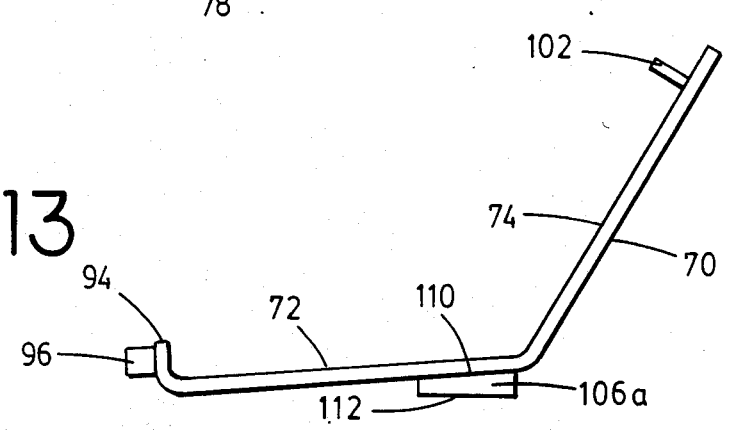
FIG. 13 is a side elevation view of the holder shown in FIG. 12.
Figure 11:
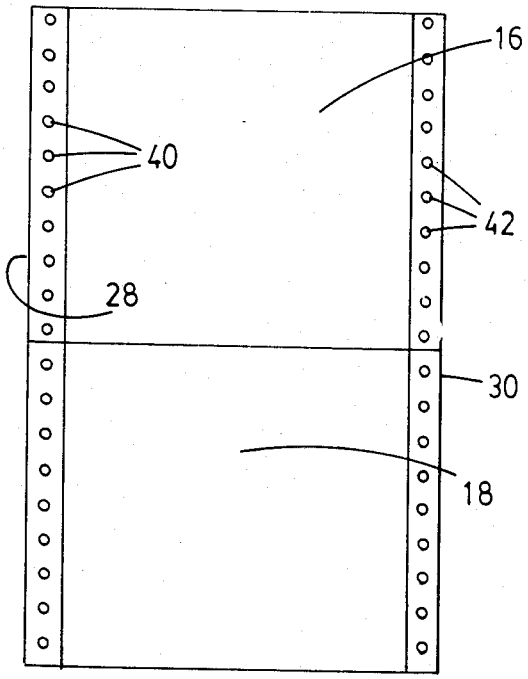
FIG. 11 is a plan view of a computer print-out for use with the holders in accordance with this invention.
Figure 12:
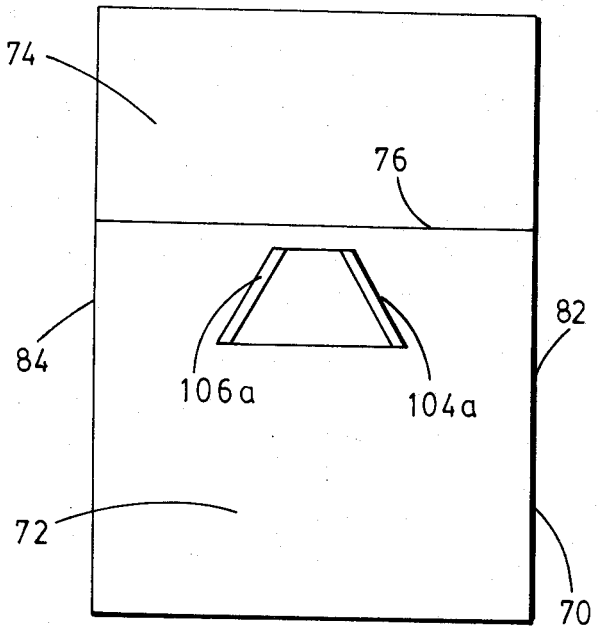
FIG. 12 is a bottom plan view of the holder of FIG. 6 having a modified support base.

A holder for working with a commputer print-out in accordance with this invention includes a unitary stand 2 having the shape in side elevation of an inverted V, comprising a front panel 4 which converges upwardly from its bottom edge 6 to its top edge 8 to meet and integrally join the top edge 10 of rear panel 12.

The height of rear panel 12 from its top edge 10 to its bottom edge 14 is approximately the same as that of front panel 4 from its top edge 8 to its bottom edge 6. The rear panel 12 also converges upwardly toward the junction with front panel 4, both panels 4 and 12 converging toward each other at approximately the same angle.

The longitudinal dimension of each panel 4 and 12 between its respective top edge 8 and 10 and its respective bottom edge 6 and 14 is slightly greater than the corresponding longitudinal dimension of sheet 16 of a computer print-out 18 for which the stand 2 is used.

The lateral dimension of each panel 4 and 12 between the said edges 20 and 22 is slightly greater than, or equal to, the corresponding lateral dimension of the sheet 16 of a computer print-out 18 for which the stand 2 is intended to be used.

Front panel 4 includes a left hand margin 24 along side edge 20 and a right hand margin 26 along the opposite side edge 22. The margins 24 and 26 are spaced apart the same distance as the left hand margin 28 and right hand margin 30 of the sheets 16 of the computer print-out 18 for which the stand 2 is intended to be used. Pegs 32 and 34 are provided in the left hand margin 24 of front panel 4 projecting outwardly therefrom and being spaced apart longitudinally, peg 32 being nearer the bottom edge 6 of panel 4 and peg 34 being nearer the top edge 8 thereof. Pegs 36 and 38 are provided in the right hand margin 26 of front panel 4 projecting outwardly therefrom and being spaced apart longitudinally, peg 36 being nearer bottom edge 6 of panel 4 and peg 38 being nearer the top edge 8 thereof. Lower pegs 32 in the left hand margin and 36 in the right hand margin lie substantially in the same horizontal plane, and upper pegs 34 in the left hand margin and 38 in the right hand margin lie substantially in the same horizontal plane. The pegs 32 and 34 are positioned on the front panel 4 to be received through correspoding ones of apertures 40 in the left hand margin 28 of sheets 16 of the computer print-out 18, and pegs 36 and 38 are positioned on the front panel 4 to be received through corresponding ones of apertures 42 in the right hand margin 30 of said sheets 16 when the computer print-out 18 is placed on front panel 4.

The pegs 32, 34, 36 and 38 have a length slightly greater than the thickness of the computer print-out 18 for which the stand 2 is intended to be used.

The rear panel 12 includes a first margin 44 along side edge 20 and a second margin 46 along the opposite side edge 22. The margins 44 and 46 are spaced apart the same distance as the margins 28 and 30 of the sheets 16 of the computer print-out 18 for which the stand 2 is intended to be used. Peg 52 is provided in the first margin 44 of rear panel 12 projecting outwardly therefrom and being nearer the bottom edge 14 of panel 12. Peg 56 is provided in the second margin 46 of rear panel 12 projecting outwardly therefrom and being nearer bottom edge 14 of panel 12.

Lower peg 52 in the first margin 44 of the rear panel 12 and lower peg 56 in the opposite second margin 46 lie substantially in the same horizontal plane. The peg 52 in the margin 44 of the rear panel 12 is positioned to be received through corresponding apertures 40 in the left hand margin 28 of sheets 16 of the computer print-out 18 when they are flipped over from their position on the front panel 4, and the peg 56 in the second margin 46 of rear panel 12 is positioned to be received through corresponding apertures 42 in the right hand margin 30 of said sheets 16 of the computer print-out 18 when they are flipped over from their position on the front panel 4.

The stand 2 can then be turned or tipped rearwardly with rear panel 12 facing the person working with the computer print-out whereupon the reverse side of the sheet 16 can be viewed.

The stand 2 includes an inturned flange 60 extending inwardly in a horizontal plane along the bottom edge 6 of front panel 4 and another inturned flange 62 extending inwardly in the same horizontal plane along the bottom edge 14 of the rear panel 12. A pair of support members 64 and 66 extend between and overlie the inturned flanges 60 and 62, the support members 64 and 66 being in parallel spaced apart relationship. The ends of the support members 64 and 66 may be secured to the respective flanges 60 and 62 to strengthen and stabilize the stand 2.

A modification of the holder in accordance with this invention for working with a computer print-out is the stand 70 having a first panel 72 at a slight incline from the horizontal of about five degrees and a second panel 74 at a steeper incline of about sixty degrees. The panel 74 is integrally joined to the panel 72 along a common edge 76.

The longitudinal dimension of panel 72 from the common edge 76 rearwardly to its rearward edge 78 is approximately the same as the longitudinal dimension of the panel 74 from the common edge 76 forwardly to its forward edge 80. The longitudinal dimension of each panel 72 and 74 is slightly greater than the corresponding longitudinal dimension of a sheet 16 of a computer print-out 18 for which the stand 70 is intended to be used.

The lateral dimension of panels 72 and 74 between their opposite side edges 82 and 84 is slightly greater than, or equal to, the corresponding lateral dimension of the sheet 16 of a computer print-out 18 for which the stand 70 is intended to be used.

The slightly inclined first panel 72 includes a left hand margin 86 along side edge 82 and a right hand margin 88 along the opposite side edge 84. The margins 86 and 88 are spaced apart the same distance as the left hand margin 28 and right hand margin 30 of the sheets 16 of the computer print-out 18 for which the stand 70 is intended to be used. A peg 90 may be provided in the left hand margin 86 and a peg 92 may be provided in the right hand margin 88 of panel 72, positioned to be received through corresponding apertures 40 and 42 in the left and right margins respectively of sheets 16 of the computer print-out 18, to hold the computer print-out 18 securely in place on the panel 72. However, pegs 90 and 92 may be omitted from the slightly inclined panel 72. An upwardly extending flange 94 is provided along the rearward edge 78 of panel 72, integrally formed therewith, to serve as an abutment wall to prevent the computer print-out 18 from sliding rearwardly.

A weight bar 96 is provided along the outwardly facing wall 98 of the upwardly extending flange 94 to keep the stand 70 from tipping forward when sheets 16 of the computer print-out are positioned on the more steeply inclined panel 74.

The more steeply inclined panel 74 also includes a left hand margin 86 along side edge 82 and a right hand margin 88 along the opposite side edge 84, such margins being spaced apart on panel 74 the same distance as the left hand margin 28 and right hand margin 30 of the sheets 16 of computer print-out 18 for which the stand 70 is intended to be used. A peg 100 is provided in the left hand margin 86 and a peg 102 is provided in the right hand margin 88 of panel 74, positioned to be received through corresponding apertures 40 and 42 in the left hand right hand margins respectively of sheets 16 of the computer print-out 18 when they are flipped upwardly and rearwardly from that part of the print-out 18 lying on the first panel 72. The pegs 100 and 102 thereupon hold the sheets 16 on the more steeply inclined panel 74.

The pegs 100 and 102 have a length slightly greater than the thickness of the computer print-out 18 for which the stand 70 is intended to be used. All of the sheets 16 of the computer print-out 18 may therefor be turned or flipped from the first slightly inclined panel 72 to the second more steeply inclined panel 74. The weight bar 96 along flange 94 at the rearward edge 78 of panel 72 has sufficient weight to counter balance the weight of the entire computer print-out 18 when it has been positioned in its entirety on the more steeply inclined panel 74.

The panel 72 is maintained at its slightly inclined angle by the triangular support legs 104 and 106 extending downwardly from respective side edges 82 and 84 of the panel 72, and by the laterally extending rectangular support wall or leg 108 which extendings vertically downward from the lateral common edge 76 between panels 72 and 74.

To use stand 2, a computer print-out 18 is first positioned on the front panel 4 with the pegs 32, 34, 36 and 38 being received through corresponding apertures 40 and 42 in the left and right margins of the print-out 18. The person working with the computer print-out has the first sheet or page 16 in a convenient position in front. When through with the first sheet 16, it is flipped over on to the rear panel 12 where the apertures 40 and 42 in the margins of sheet 16 receive therethrough the corresponding pegs 52 and 56 in the margins of the rear panel 12. The flipped over page is thereby held securely on the rear panel 12.

The printed material on the back of the sheets 16 when they are flipped over to the rear panel 12 is of course upside down. However, the stand 2 can be turned or tipped rearwardly while holding the rest of the computer print-out 18 against front panel 4 with one's hands, until the front panel 4 faces the desk top or other working surface whereupon it is laid down thereon. The rear panel 12 thereupon is facing the person working with the print-out at a convenient angle and with the printed material then facig the worker right side up.

When the reverse side of the sheet 16 is finished, the worker then grasps the face down front panel 4 and that portion of the computer print-out 18 positioned on the front panel's pegs 32, 34, 36 and 38 and turns or tips the stand forwardly until the inward turned horizontal flanges 60 and 62 rest on the desk top or other working surface. At such time, front panel 4 and the next sheet 16 of the print-out is then facing the worker for processing of that page.

To use stand 70, a computer print-out 18 is first positioned on the slightly inclined panel 72 whereupon the first sheet 16 is facing the worker at a slightly inclined angle. When processing of the front side of sheet 16 is finished, it is flipped upwardly and rearwardly on to the second more steeply inclined panel 74, whereupon its pegs 100 and 102 are received through corresponding apertures 40 and 42 in the left and right margins of the print-out sheet 16 to hold it in place on the panel 74. The worker can then read and process the material on the reverse side of double sheet 16 as it is displayed on the panel 74. When that reverse side of the first double sheet 16 is completed, the front side of the next sheet 16 is already in viewing position on panel 72, and the process is completed until the entire print-out 18 has been transferred from panel 72 on the panel 74.

The stand 70 may omit triangular support legs 106 and the laterally extending rectangular support wall or legs 108. In place thereof a pair of spaced apart short legs **104*a* and 106*a* of substantially trapezoidal shape are inset from the respective side edges 82 and 84 of the bottom panel 72, extending downwardly from the underside of panel 72 near the lateral common edge 76 between panels 72 and 74 and rearwardly therefrom in an outwardly diverging direction. The upper edge 110 of each short leg 104*a* and 106*a* extends forwardly at an incline to the bottom edge 112 thereof at the same angle of inclination as the panel 72 is to the horizontal. The inset legs 104*a* and 106*a* allow clearance beneath the inclined panel 72** for computer terminal cords when the print-out holder is used in close proximity to the computer and the electric cables or cords extending therefrom.

In the form of the invention shown in FIGS. 1–5 and 14, when the stand 2 is tipped rearwardly to position panel 4 horizontally and facing downwardly and panel 12 is brought into a diagonal position facing the worker who is working with the computer print-out on the stand 2, at such time the pegs 32, 34, 36 and 38 serve as support legs resting on a horizontal working surface.

Figure 14:
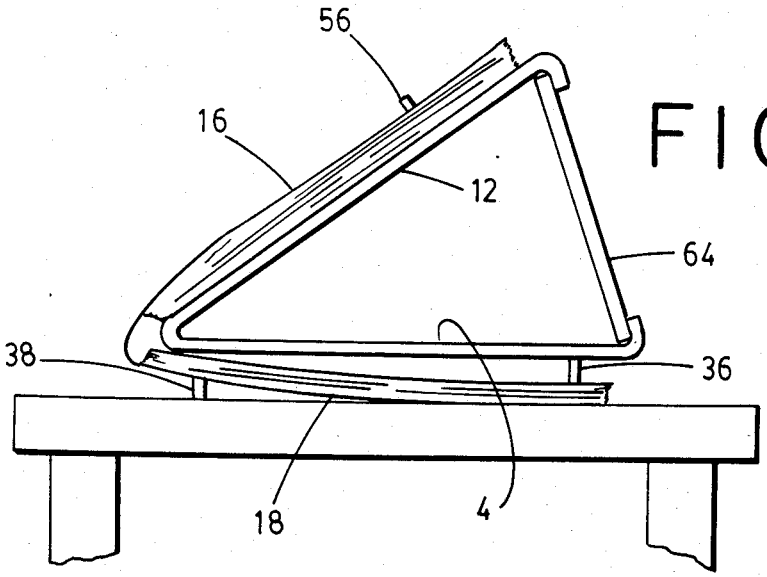
FIG. 14 is a side elevation view of the holder shown in FIG. 2, showing the front panel 4 tipped rearwardly and facing downwardly with rear panel 12 brought into diagonal viewing position.

The stand 2 may also be mounted on a pivotable frame with a pivot member rigidly affixed to and extending out from each opposite side of the stand 2, such pivot members being rotatably received in corresponding bearing members of a pivotable frame. The stand 2 could then be pivoted between the two positions described on such fame member, the first position being as shown in FIGS. 1–5 wherein panel 4 is in a diagonal position facing the viewer and the second position being as shown in FIG. 14 wherein panel 12 is in the diagonal position facing the viewer and panel 4 is facing downwardly. Lock means could be provided to lock the stand 2 in each of such positions on the frame when picoted thereto.

We claim:

1. A holder for working with computer print-outs in combination with a computer print-out, comprising a first support means to hold a computer print-out comprising a plurality of joined sheets folded one on top of another in a stack and to display a top one of said sheets to a worker for processing, a second support means in longitudinal alignment with said first support means formed integrally therewith and permanently held at a rigid angle thereto to comprise a unitary stand to receive and hold said top one of said sheets when lifted from said stack and pivotally flipped toward said integrally formed second support means for positioning thereon and to then display to said worker a second one of said sheets joined to said top one, including first holding means to releasably hold said sheets of said computer print-out on said first support means when placed thereon and second holding means to hold said sheets of said computer print-out on said second support means when placed thereon, including said computer print-out thereon, said computer print-out comprising a plurality of longitudinally joined continuous sheets of paper folded one on another along laterally extending fold lines, each of said sheets having a longitudinally extending left hand margin along one side thereof and a longitudinally extending right hand margin along the opposite side thereof, each of said margins including a plurality of uniformly spaced apart apertures therein, said first and second holding means being positioned on said first and second support means respectively to engage corresponding ones of said apertures in said left and right hand margins for holding said sheets thereon.

2. A holder for working with computer print-outs in combination with a computer print-out as set forth in claim 1, wherein said first support means includes a first panel having an upper laterally extending edge and a lower laterally extending edge, said second support means includes a second panel having an upper laterally extending edge and a lower laterally extending edge, said first and second panels being integrally joined along their said upper laterally extending edges and extending downwardly diverging outwardly to form an inverted V-configuration in side elevation, said first and second panels being rigidly held in such configuration to comprise a unitary stand, said first holding means includes a first peg projecting outwardly from the face of said first panel along a first side edge thereof and a second peg projecting outwardly from the face of said first panel along the opposite second side edge thereof, said second holding means includes a third peg projecting outwardly from the face of said second panel along a first side edge thereof and a fourth peg projecting outwardly from the face of said panel along the opposite second side edge thereof, said pegs engaging corresponding ones of said apertures in respective ones of said margins of said sheets of said computer print-out.

3. A holder for working with computer print-outs in combination with a computer print-out as set forth in claim 2, wherein said first and second pegs are relatively closer to said lower edge than to said upper edge, and wherein said first holding means includes a first additional peg projecting outwardly from the face of said first panel along said first side edge thereof relatively closer to said upper edge than to said lower edge thereof and a second additional peg projecting outwardly from the face of said first panel along said opposite second side edge thereof relatively closer to said upper edge than to said lower edge thereof, said first peg and said first additional peg engaging corresponding apertures in said left hand margin of said sheets, said second peg and said second additional peg engaging corresponding apertures in said right hand margin of said sheets.

4. A holder for working with computer print-outs in combination with a computer print-out as set forth in claim 3, including a first laterally extending inturned flange integrally formed along said lower laterally extending edge of said first panel, and a second laterally extending inturned flange integrally formed along said lower laterally extending edge of said second panel, said first and second inturned flanges extending toward each other in the same horizontal plane from the respective bottom edges of their respective first and second panels.

* * * * *

UNITED STATES PATENT OFFICE

CERTIFICATE OF CORRECTION

Patent No. 4,611,719 Dated September 16, 1986

Inventor(s) D'Ann Dudek; Wilma Dudek

It is certified that error appears in the above-identified patent and that said Letters Patent are hereby corrected as shown below:

Line 41, Col. 3, after through, delete "correspoding"

insert - -corresponding- -.

Line 7, Col. 5, after the left, delete "hand"

insert - -and- -.

Line 52, Col. 5, after then, delete "facig"

insert - -facing- -.

Signed and Sealed this

Eighteenth Day of November, 1986

*Attest:*

DONALD J. QUIGG

*Attesting Officer* *Commissioner of Patents and Trademarks*

UNITED STATES PATENT OFFICE

CERTIFICATE OF CORRECTION

Patent No. 4,611,719 Dated September 16, 1986

Inventor(s) D'Ann Dudek; Wilma Dudek

It is certified that error appears in the above-identified patent and that said Letters Patent are hereby corrected as shown below:

Col. 6, line 48, delete "picoted" and insert - -pivoted- -.

Signed and Sealed this

Twenty-third Day of December, 1986

*Attest:*

DONALD J. QUIGG

*Attesting Officer* *Commissioner of Patents and Trademarks*